US011297928B2

(12) United States Patent
Rhodes

(10) Patent No.: US 11,297,928 B2
(45) Date of Patent: Apr. 12, 2022

(54) EXPANDABLE ARM MOUNTED APPARATUS

(71) Applicant: James Darren Rhodes, Van Nuys, CA (US)

(72) Inventor: James Darren Rhodes, Van Nuys, CA (US)

( * ) Notice: Subject to any disclaimer, the term of this patent is extended or adjusted under 35 U.S.C. 154(b) by 100 days.

(21) Appl. No.: 16/378,536

(22) Filed: Apr. 8, 2019

(65) Prior Publication Data

US 2020/0315328 A1 Oct. 8, 2020

(51) Int. Cl.
*A45F 5/00* (2006.01)

(52) U.S. Cl.
CPC ..... *A45F 5/00* (2013.01)

(58) Field of Classification Search
CPC ..... A45F 5/00; A47F 5/00; A47F 7/00; A47F 13/00; A47F 13/08; A47F 5/06
USPC ..... 294/161; 441/56
See application file for complete search history.

(56) References Cited

U.S. PATENT DOCUMENTS

2007/0132260 A1* 6/2007 Lord ..... A47G 19/08 294/161
2009/0195005 A1* 8/2009 Lord ..... A47G 19/08 294/161

* cited by examiner

*Primary Examiner* — Lars A Olson

(57) ABSTRACT

An arm mounted apparatus which secures to a user's arm and contains extending arms designed for holding items or other uses. Said arms may be designed to contract in and out of said apparatus by use of the fingers on the arm it is worn on.

20 Claims, 6 Drawing Sheets

EXPANDABLE ARM MOUNTED APPARATUS

CROSS REFERENCE TO RELATED APPLICATION

This application claims the benefit of NonProvisional U.S. patent application Ser. No. 15/196,037, filed Jun. 29, 2016, which application is hereby incorporated by reference along with all references cited therein.

BACKGROUND OF THE INVENTION

This invention relates to a new and novel technology and use for an expandable arm mounted apparatus.

One embodiment of the invention is designed to increase efficiency, effectiveness, and safety in the restaurant and food service industry.

Food service workers provide many functions but one function they all do across the board is to carry plates and trays. They use their hands to carry them from the kitchen to the table, and then they use their hands to carry them back again, often carrying as many at one time as possible to increase efficiency at a cost to their bodies, health, and safety.

Both the heat of a plate and the weight of said plate cause issues to the health and well being of food service workers. I have personally worked in the food service industry for years and have issues with my wrists resulting from the repetitive action of carrying heavy plates.

Mostly, plates are round and carried by placing a thumb over their outer edge with the remaining fingers of the hand under the bottom of the plate. The bulk mass of the plate therefore extends outward from the hand creating a leveraging force acting upon the carrier's thumb, hand, and wrist. It also has harmful long term effects on a carrier's elbow, shoulders, and back. The costs of this repetitive motion wear and tear, and resulting industries is huge for both the individual food service worker and the industry itself. Healthcare costs for treatment as well as day's of work missed by affected workers are huge both in regards to social and economic costs. It almost goes without question that people in any industry who carry heavy loads with their hands and fingers will almost without exception experience pain and injuries resulting from their daily work.

This invention takes the weight and leverage of a plate off of the server's wrist and hand and places it on the server's forearm allowing for more ergonomic function and sparing server's from repetitive motion injuries. A server simply picks up a plate and inserts it between arms extending from the apparatus secured to their forearm, walk to the table, and then slide the plate out from the apparatus arms and place it on the table. They no longer need to carry these plates with their hands and fingers to the table or necessarily support that unhealthy leveraged weight from the kitchen to the table, or from the table back to the kitchen. It also largely eliminates the equally non-ergonomic action of hosting a tray full of heavy plates over their head and carrying said weighted tray over one shoulder to the table along with a tray stand, positioning said tray stand in place while sustaining the tray over their shoulders, then awkwardly lowering the heavy tray from over their shoulder down onto the tray stand. Traditionally four top tables have always been served this way because a server can usually transport no more than 3 plates full of food at the same time without the use of an assistant server or a tray. Carrying 3 plates full of food is possible, but it is harmful to the health of a server.

An optional support connecting the forearm assembly to a portion of the arm above the elbow can be employed to prevent the elbow from bending beyond a healthy angle. This will allow a server to carry weight while resting their forearm in addition to their wrist for even greater protection.

Another embodiment shown in FIGS. 9 and 10 allow a user with injured wrists or with the desire to protect their wrists to protect their wrists without losing the ability to perform certain functions such as curls or press downs on a weight machine. Any person who has ever injured their wrists will quickly tell you that it's impossible to perform curls or other exercises to maintain optimal physical fitness with injured or painful wrists. With this embodiment of the apparatus we seek to provide a solution to their problem which has remained unaddressed to date.

DETAILED DESCRIPTION OF PREFERRED EMBODIMENTS

Figure 1:
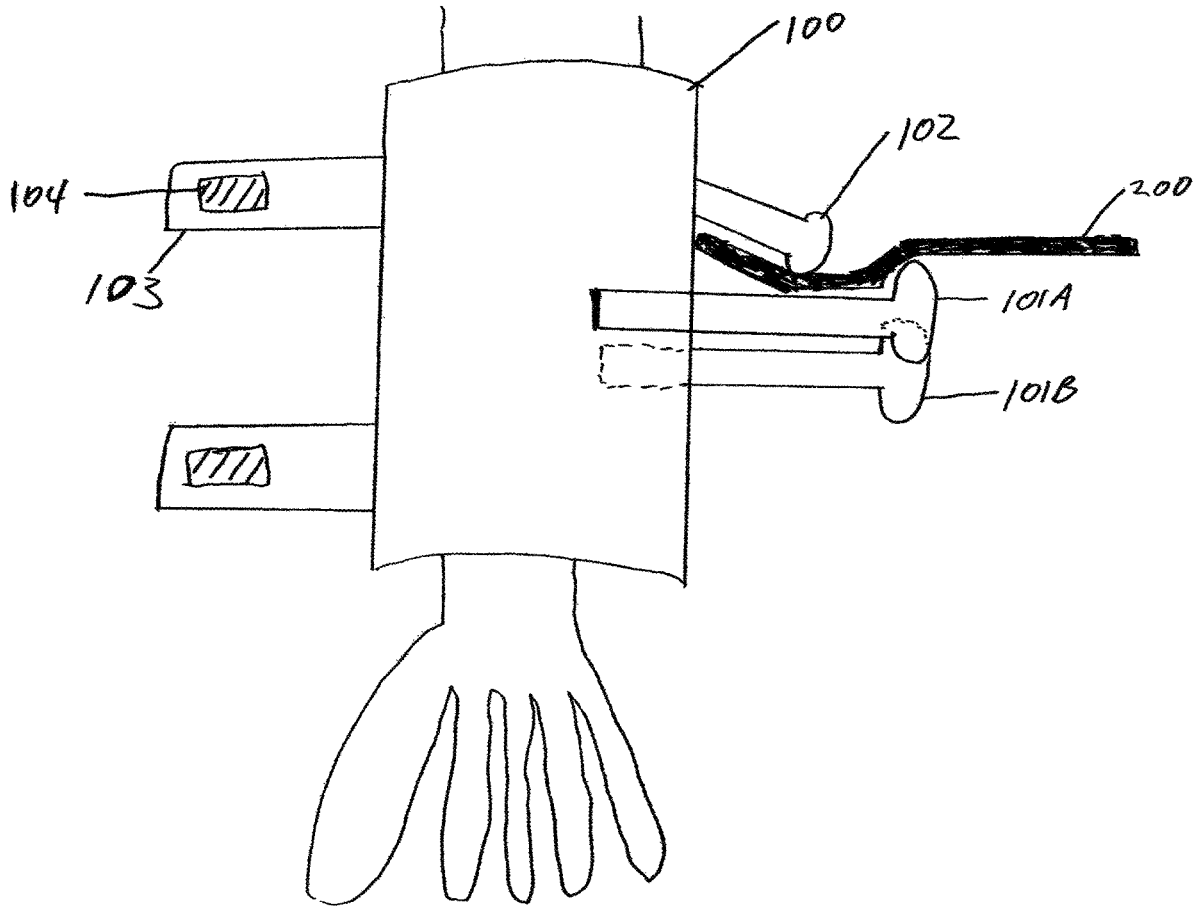
FIG. 1 shows a side view of an embodiment of the apparatus with arms permanently secured to the forearm mount in fixed non moving positions.
Figure 2:
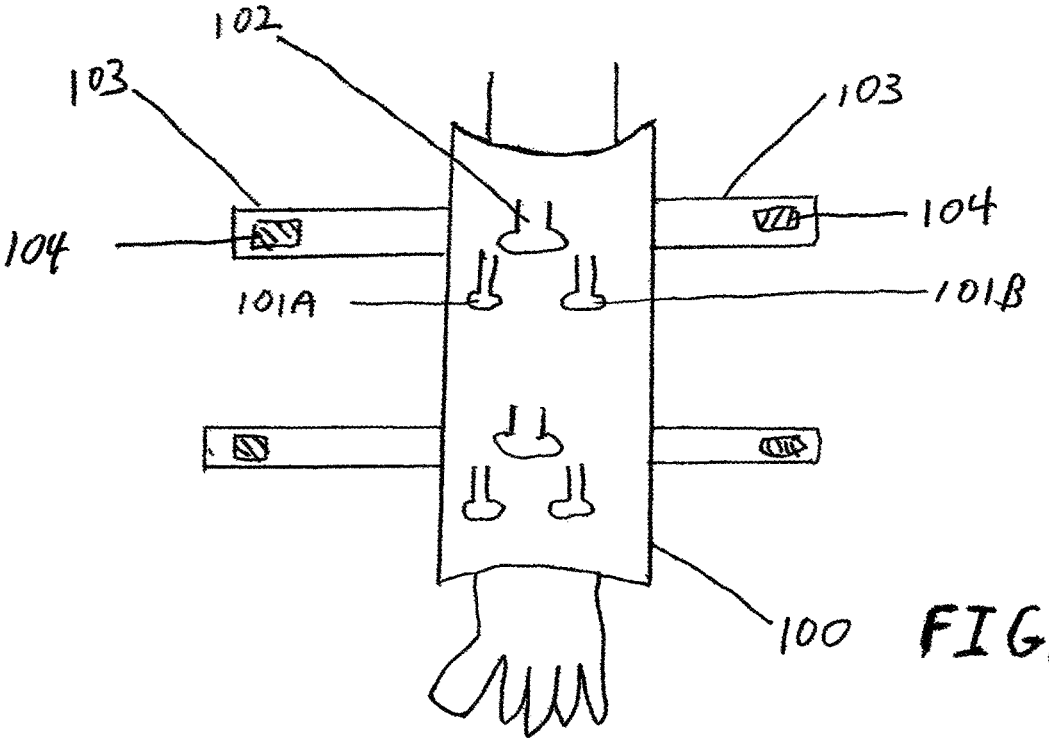
FIG. 2 shows a front view of an embodiment of the apparatus with arms permanently secured to the forearm mount in fixed non moving positions.

FIG. 1 shows an embodiment of the arm mounted apparatus with bottom plate holding arms 101A and 1018 and top plate securing arm 102 in permanent locked position. Bottom arms 101A and 1018 extend out from both the left and right sides of the apparatus at approximately a 90 degree angle. They support the plate from the bottom part of the plate and have an optional spherical portion at their ends to help secure the plate better. They are made of plastic or a plastic composite and preferable coated in a cushioning nonslip rubber like material. The sphere or bulb is designed to fit onto a plate past the bottom rim. Plates and dishes usually have a small rim or lip at their bottom edges and curve upwards on their top edges to keep liquids and juice from running off them onto the table.

The top arm 102 is constructed of a similar plastic or composite material and coated in rubber but can be angled slightly downward toward the end of the apparatus facing the user's hand. The angle of their downward descent is designed to fit over the upsloped angle of a plate's rim. Thus a plate fits in between the bottom two arms 101A and 1018 and the top part of the plate is secured by fitting under angled top arm 102.

Any number or combinations of top and bottom arms can be used limited only by the space required to hold a plate and the space available on the forearm mount 100 on which to mount arms. I currently favor the use of four sets of top and bottom arms on said forearm mount so that four plates can be carried by the arms with one additional plate carried in each of the server's hands.

Figure 3:
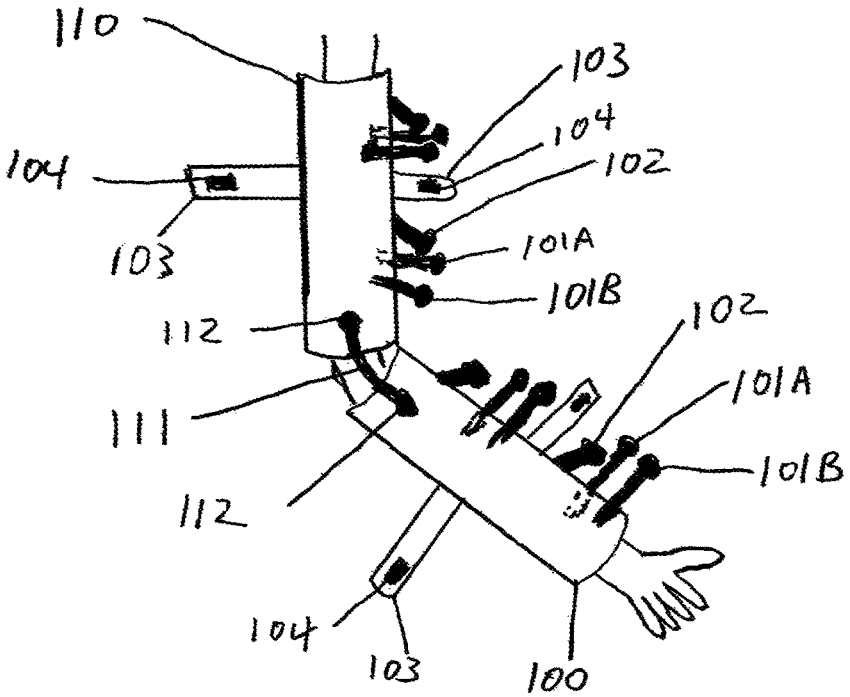
FIG. 3 shows an embodiment of the apparatus employing both upper and lower arm attachments for carrying plates.

FIG. 3 shows an embodiment of the apparatus using both an upper arm mount 110 connected to a lower forearm mount 100. Both upper and lower arm mounts are equipped with arms to carry plates though the top arm mount 110 can be used without plate carrying arms 101 and 102. The top arm mount may have plates too close to the server's armpit.

An optional top arm mount 110 is connected to forearm mount 100 by hinge or bending bracket 113 and cable 111 are secured to both the top and bottom mount by bolts or securing points. Cable 111 can be made of any non-flexible material. Any number of attachment methods can be used here but the benefit of cable 111 is that it can prevent the elbow from extending past a certain point short of 180 degrees. Thus keeping a slight bend at the user's elbow while holding it in place there such that a server's arm while holding plates is not completely at their side causing interference by the server's body but is able to relax with a slight bend and still keep the plates an optimal distance from the server's body. Thus even if no plate holding arms at all are added to top arm mount 110 it would still be of benefit in more ergonomically distributing the weight of plates carried by forearm mount 100.

Figure 4:
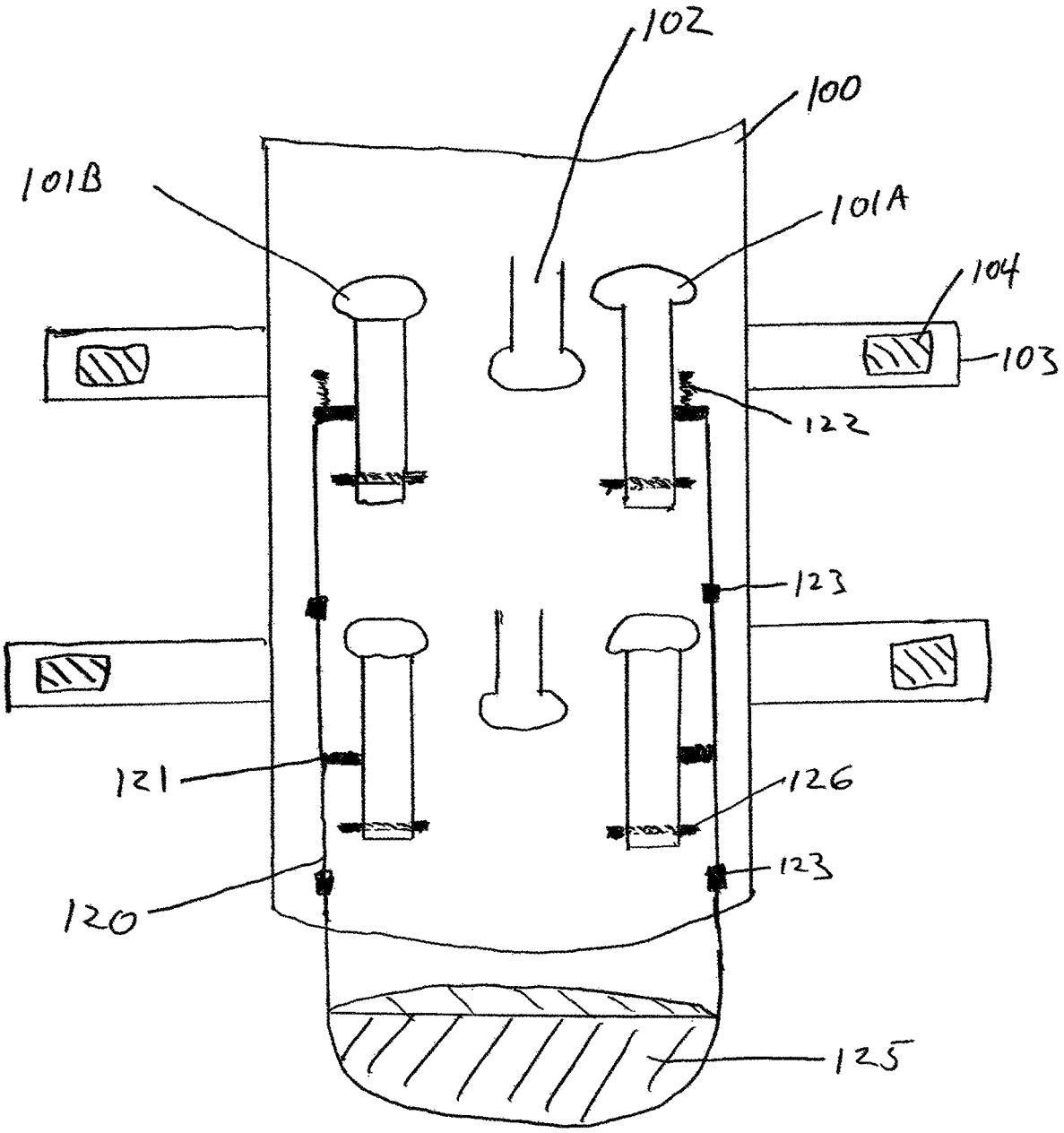
FIG. 4 shows a front view of an embodiment of the apparatus with extending and collapsing arms for a more streamline appearance without sacrificing function.
Figure 5:
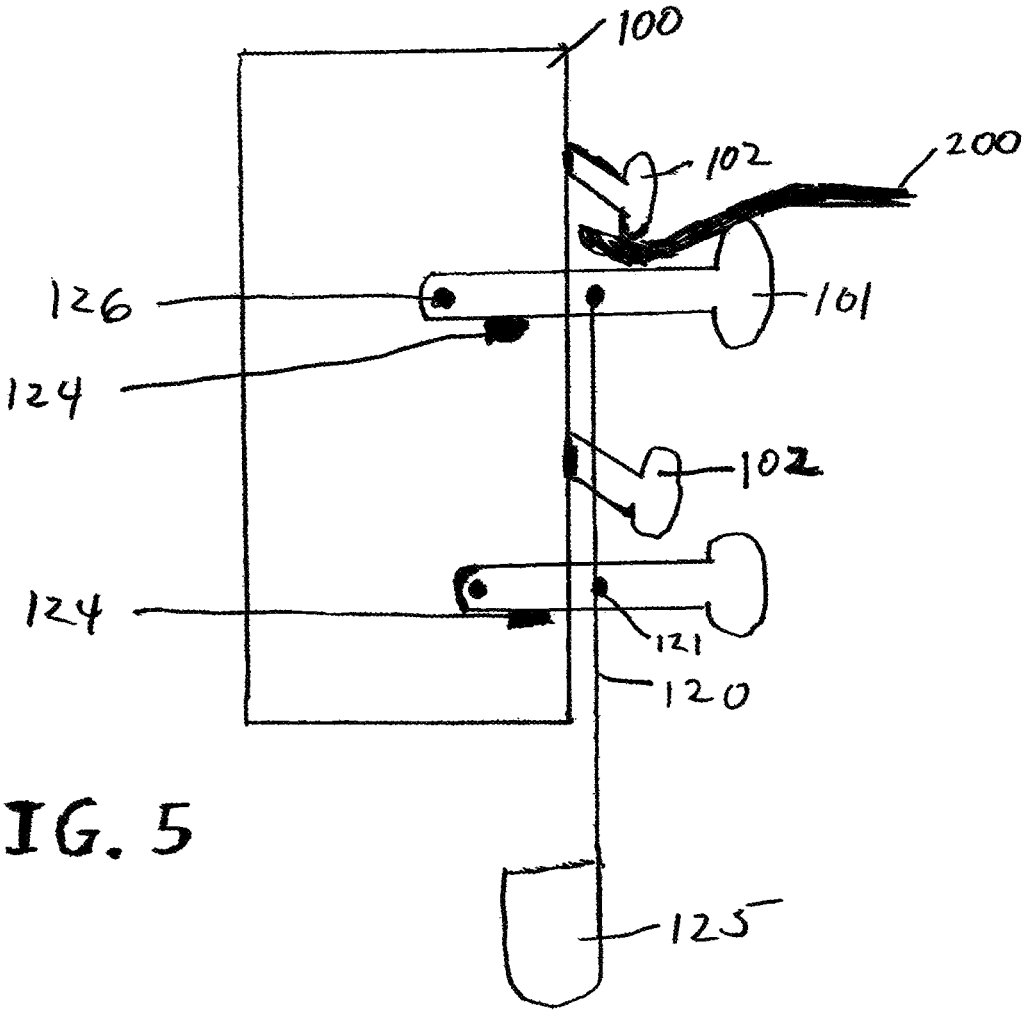
FIG. 5 shows a side view of an embodiment of the apparatus with extending and collapsing arms.

FIGS. 4 and 5 show embodiments of the apparatus where the arms fold into the unit and extend outward to hold plates when acted upon by the user inserting at least one finger into finger pocket 125 and leveraging it out and away from the forearm mount 100. Finger pocket 125 is connected by some means such as in this embodiment, a wire or cable 120 to connection points 121 on each of the lower extending support arms 101A and 1018. When the finger pocket is pushed down the cable connected to each of the arms is pulled down thus forcing each of the arms to fold down into plate carrying position. The same method could be employed with another cable running to the shorter top arm 102 if desired so that it could also fold up and down but since arm 102 is shorter than arms 101A and 101B I didn't consider it an aesthetic advantage to have it fold so I left it locked in place. The same method could be employed to have it fold if desired with a cable running up the center of the forearm mount 100. For ease of design and assembly I also have each of the cables connecting the arms to be the same length and therefore positioned the arms at the same distance from each other on forearm mount 100. I also included optional cable guides 123 before each arm through which cable 120 runs to hold the cable close to the forearm mount 100 so that it doesn't interfere with plates being positioned in the arms. The same guide 123 would be used on the center of forearm mount 100 if the smaller top arms 102 are desired to expand out as well. Guide 123 is simply a small tunnel molded into the forearm mount 100 for the wires to run through.

Finger pocket 125 is a simple harness or pocket connected to cable 120 so that the fingers can pull the arms down for easy operation. It could be connected to forearm mount 100 so that it slides up and down on a guide and thus doesn't interfere with the server's hand.

Spring or tensioner 122 connects expansion arms 101A and 101B to the forearm mount such that tension is applied pulling each arm back into the forearm mount 100 such that once the last plate being held by the apparatus is removed the arms automatically pulled back against the forearm mount into a compact and closed position. It is attached to the top arm in this embodiment so that all of the other arms below it and connected to it are automatically acted upon without the need for independent tensioners. The tension will also pull the finger pocket back into the unit via cable 120.

The forearm mount 100 is secured into a fixed position on a server's forearm using straps 103 and a hook and loop securing method 104 or similar attachment method. I've used two strap 103 on the forearm mount 100 and one on upper arm mount 110 if desired. Forearm mount 100 could be made from molded plastic and a non-slip pad could be secured to it's bottom side to add a comfortable layer between the forearm mount and the user's arm. The pad could be attached in the same manner shin pads are manufactured for soccer players but thinner as this is for comfort not impact protection.

Locks or catches 124 can be molded into the forearm mount 100 to add additional support to the bottom of arms 101A, 1018 and 102 if desired. This will still allow movement in the arms but offer additional support to prevent them from extending past their desired locking point under the weight of plate or dishes 200 they're supporting.

The pivoting arms 101A and 1018 are mounted to forearm mount 100 using a simple smooth cylindrical axle 126 which is ran through slightly raised plastic mount on the forearm mount and then through and equivalently shaped cylindrical hole drilled through the base of arms 101A and 101B such that they can pivot on the forearm base.

Figure 6:
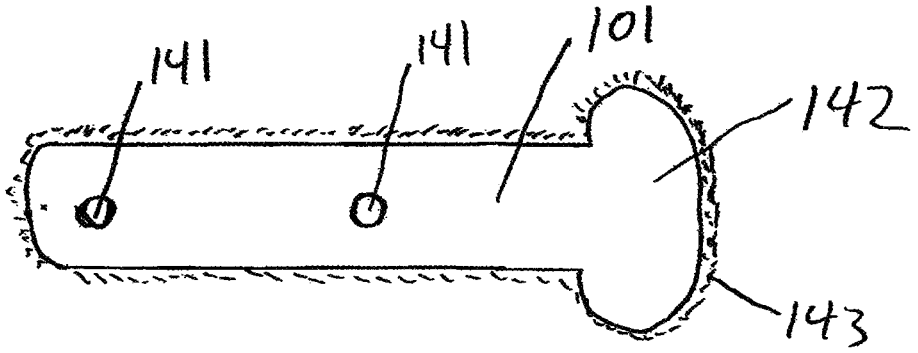
FIG. 6 shows a detailed view of an embodiment of the apparatus of lower dish support arms 101A and 101B.

FIG. 6 shows an embodiment of the apparatus's lower dish support arm 101. Holes 141 are molded are drilled into it for pivot axle 126 and attachment point 121 for cable 120. Knob 142 is molded into it's outer in to best support a plate or dish 200 under said plate 200's bottom lip. A non-slip rubber coating surrounds the arm to prevent any slippage of plate 200.

Figure 7:
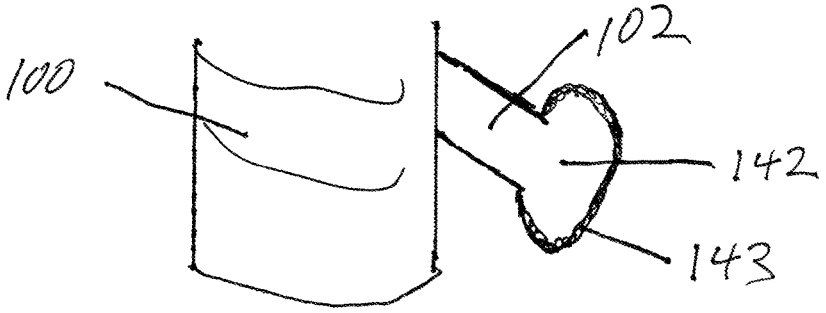
FIG. 7 shows an embodiment of the apparatus with upper support arm 102 having a downsloping angel to lock in the top of plate or dish 200.

FIG. 7 shows an embodiment of the apparatus's upper support arm 102 with a downsloping angle to lock in the top of plate or dish 200. Like arm 101 it also has knob 142 at its end and is coated in non-slip rubber 143.

Figure 8:
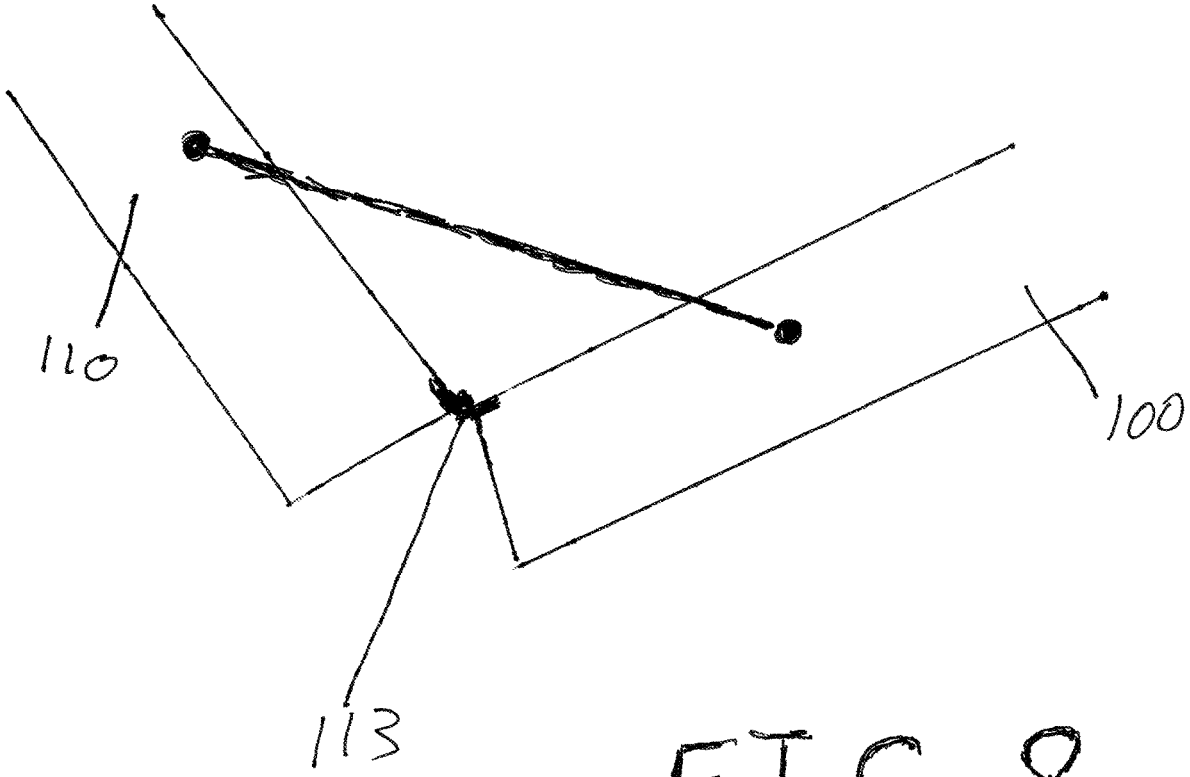
FIG. 8 shows an embodiment of the apparatus with top arm mount 110 connected to forearm mount 100.

FIG. 8 shows an embodiment of the apparatus with top arm mount 110 connected to forearm mount 100. The two are open at the outer side of the elbow but connected optionally to each other by a hinge 113 at the inside elbow at the crease of the arm possibly covered witih a fabric or similar material for comfort. Flexible band or cable 111 which allows the server to bend their arm up to a certain angle when the band pulls tight and prevents the arm from reaching a straight down position. Band 111 is attached via bolts or similar method at attachment point 112 on upper and lower arm mounts 100 and 110.

Figure 9:
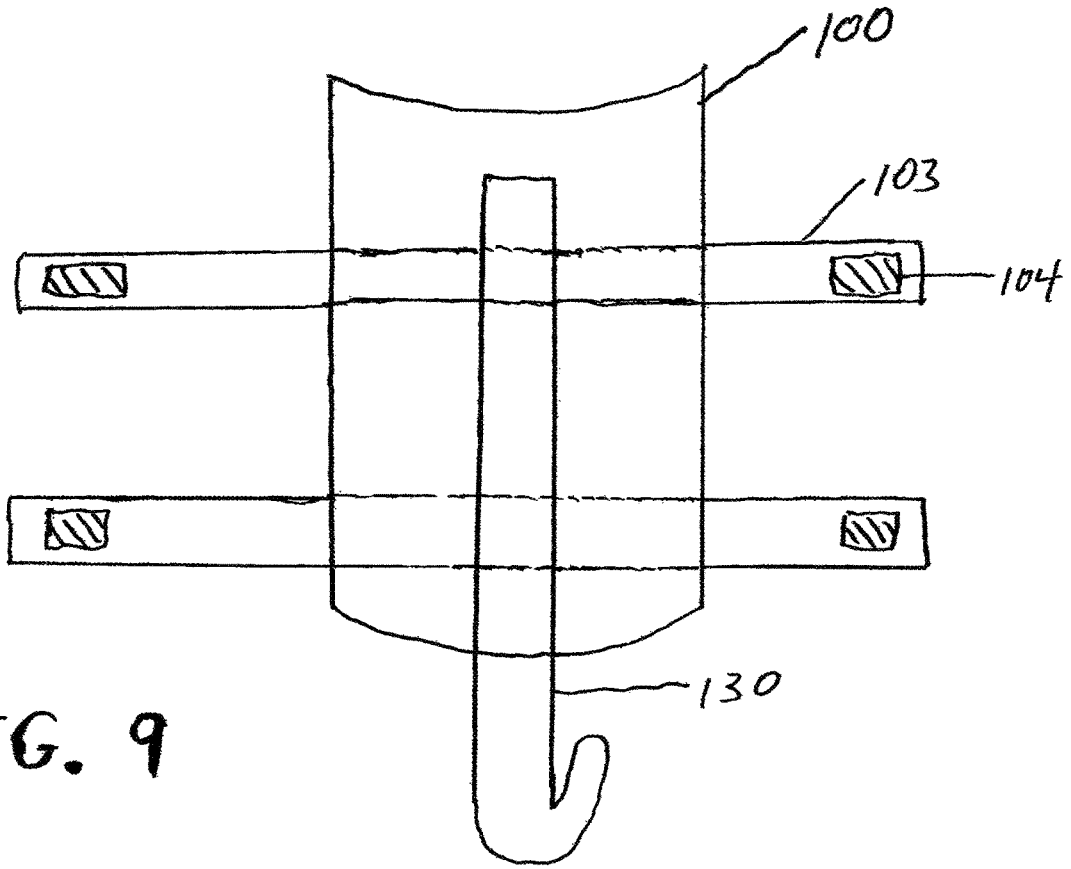
FIGS. 9 and 10 show an embodiment of the apparatus where it's designed to allow a user to handle weights and work out without placing unwanted strain on their wrists.
Figure 10:
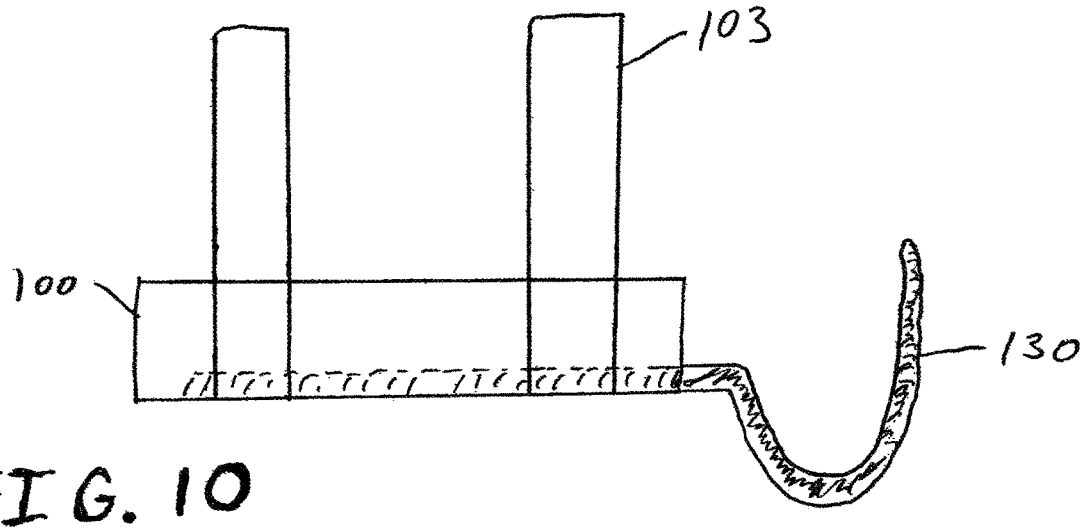

FIGS. 9 and 10 show an embodiment of the apparatus that is designed to carry and support weight with the forearms instead of the wrists. A metal rod runs through forearm mount 100 and comes out of the hand side. Rod 130 has an extended hook or loop at it's end designed to hook things and pick them up without placing weight on a user's wrists. If a user is working out for example they can simply hook a dumbbell through the loop of rod 100 and then perform curls to strengthen the arms sparing the wrists from unwanted pressure. Rod 130 runs between forearm mount 100 and the user's arm so the straps 103 secure it in place along with forearm mount 100. Using this embodiment of the apparatus a user with carpal tunnel or other wrist injuries can still perform simple functions such as carrying items which can be hooked or working out with weight bars and dumbells. A lock can be added to the end of the hook if desired to prevent an item from slipping off.

I claim:

1. A forearm mounted mobile apparatus for at least one flat object with a raised lip comprising:

a stationary forearm mounted portion secured to a user's forearm; and a means for securing said forearm mount to said user's forearm; and a plurality of extension arms attached to said forearm mount;

wherein said plurality of extension arms extend directly out from said forearm mount;

and wherein at least one lower extension arm is attached to said forearm mount for the purpose of supporting the lower side of at least one said flat object:

and where at least one upper extension arm is located above said lower extension arm of said forearm mount for the purpose of securing the top of at least one said flat object;

whereby said object can be removably inserted between said lower and upper extension arms such that said object extends securely outward from said user's forearm.

2. The apparatus of claim 1, further comprising that;

At least some portion of said top extension arm is positioned at a downward angle to accommodate and support the top of at least one said flat object with raised lip.

3. The apparatus of claim 1 for use in the food service family of flat objects with raised lips including but not limited to plates, trays, dishes, saucers, and bowls.

4. The apparatus of claim 1, further comprising;

At least one retracting extension arm that reversibly folds in toward and away from said forearm mount.

5. The apparatus of claim 4, further comprising;

A catch located on a handside portion of said forearm mount which is designed to accommodate at least one finger of said user's hand on the arm that said apparatus is secured to; and whereby said catch is connected to at least one of a plurality of retracting extension arms located on said forearm mount;

such that when said catch is acted upon by some portion of said user's hand at least one of said connected plurality of extension arms is caused to reversibly move.

6. The apparatus of claim 5, further comprising;

that said catch is connected to a plurality of said retractable arms such that when said catch is acted upon, all said plurality of retractable extension arms to which said catch is connected are caused to move together on said forearm mount as a result of that one action of said user's hand.

7. The apparatus of claim 5, further comprising;

A tensioner connected to at least one of said retracting extension arms which pulls at least one of said retracting extension arms into collapsed position on said forearm mount.

8. The apparatus of claim 1, further comprising;

An upper arm mount secured to some portion of a user's body above the elbow which connects to said forearm mount such that it limits the motion of said forearm mount by preventing a user's elbow from bending past a certain point.

9. The apparatus of claim 8, further comprising that;

Said upper arm mount which is mounted above said elbow includes at least one upper extension arm and at least one lower extension arm for the purpose of securing a said flat object with a raised lip between them.

10. The apparatus of claim 1, further comprising;

A series of said top and bottom extension arms connected directly to said forearm mount for securing multiple flat objects with raised lips one above the other.

11. The apparatus of claim 5, further comprising;

A series of said moving retractive extension arms connected to said forearm mount and said catch for the purpose of securing multiple flat objects with raised lips.

12. A forearm mounted mobile object securing apparatus comprising:

a stationary forearm mounted portion secured horizontally to a user's forearm;

a means for securing said forearm mount horizontally to said user's forearm:

a plurality of extension arms attached directly to said forearm mount;

wherein at least one lower extension arm is attached directly to said forearm mount for the purpose of supporting the lower side of an object;

and at least one upper extension arm is attached directly to said forearm mount above said lower extension arm on said forearm mount for securing the top of said object;

whereby at least one object may be reversibly inserted between said lower and said upper extension arms for the purpose of securement.

13. The apparatus of claim 12, further comprising;

A harness located on a handside portion of said forearm mount which is designed to accommodate at least one finger of said user's hand on the arm that the apparatus is secured to; and whereby said harness is connected to at least one of a plurality of retracting extension arms located on said forearm mount;

so that when said harness is acted upon by some portion of said user's hand at least one of said connected plurality of extension arms is caused to reversibly move.

14. The apparatus of claim 13, further comprising;

a tensioner which pulls at least one of said extension arms in toward a collapsed position on said forearm mount when not acted upon by said connecting harness.

15. The apparatus of claim 12 wherein said apparatus is intended for use with items in the food service family including but not limited to plates, trays, dishes, saucers, and bowls.

16. The apparatus of claim 12 further comprising;

a series of said extension arms designed for securing multiple flat objects with raised lips one above the other along said forearm mount.

17. The apparatus of claim 12, further comprising;

At least one top extension arm positioned at a downward angle to support the top of an object.

18. The apparatus of claim 12, further comprising;

An upper arm mount secured to some portion of a user's body above the elbow which connects to said forearm mount such that it limits the motion of said forearm mount by preventing a user's elbow from bending past a certain point.

19. A forearm mounted apparatus secured to the forearm of a user comprising:

a means for securing a forearm mount around said forearm of said user;

a second portion extending from said forearm mount culminating in an attachment mechanism which extends out of the palm side of said forearm mount;

wherein said attachment mechanism has a latch which can open and close;

And whereby a finger catch designed to accommodate at least one finger of said user is connected to said attachment mechanism such that when said finger catch is acted upon said attachment mechanism latch is caused to reversibly open;

and whereby a tensioner is connected to said attachment mechanism which pulls said attachment mechanism latch toward a closed position when not acted upon by said finger catch.

20. The apparatus of claim 19 where said apparatus is intended for use with items in the exercise equipment family including but not limited to: barbells, dumbbells, curl bars, weight machines, dip bars, and free weights.

* * * * *